United States Patent [19]

Nagahara et al.

[11] Patent Number: 4,793,240

[45] Date of Patent: Dec. 27, 1988

[54] ADJUSTABLE DEVICE FOR AXIAL PISTON PUMP/MOTOR OF A TILTING AXIS TYPE

[75] Inventors: Yoshikazu Nagahara, Yokohama; Michio Onzo, Kawasaki, both of Japan

[73] Assignee: Kabushiki Kaisha Komatsu Seisakusho, Tokyo, Japan

[21] Appl. No.: 877,942

[22] Filed: Jun. 24, 1986

[30] Foreign Application Priority Data

Jun. 26, 1985 [JP] Japan ..... 60-137870

[51] Int. Cl.[4] ..... F01B 3/00; F04B 1/30

[52] U.S. Cl. ..... 91/506; 92/12.2; 92/52; 417/222

[58] Field of Search ..... 92/51-53, 92/12.2; 417/216, 218, 222; 91/504-506

[56] References Cited

U.S. PATENT DOCUMENTS

| | | | |
|---|---|---|---|
| 2,905,150 | 9/1959 | Ebert | 92/52 |
| 3,429,225 | 2/1969 | Reyworth | 91/506 |
| 3,943,828 | 3/1976 | Wagenseil | 91/505 |

FOREIGN PATENT DOCUMENTS

| | | | |
|---|---|---|---|
| 73609 | 4/1984 | Japan | 92/53 |
| 928977 | 6/1963 | United Kingdom | 92/52 |
| 1546090 | 5/1979 | United Kingdom | 92/51 |

*Primary Examiner*—William L. Freeh

*Attorney, Agent, or Firm*—Armstrong, Nikaido, Marmelstein & Kubovcik

[57] ABSTRACT

The heretofore known adjusting device for an axial piston pump/motor of a tilting axis type in which a tilt angle of a valve plate is varied by rocking the valve plate along arcuate guide grooves formed in an end cover of the axial piston pump/motor is improved so as to reduce the size of the adjusting device in the direction of its stroke by assembling a sleeve or sleeves and a piston fitting in the sleeve or sleeves in a telescopic structure within a cylinder formed in the end cover along a rocking direction of the valve plate, and by providing a trunnion pin engaged with the valve plate in the piston.

3 Claims, 3 Drawing Sheets

ADJUSTABLE DEVICE FOR AXIAL PISTON PUMP/MOTOR OF A TILTING AXIS TYPE

BACKGROUND OF THE INVENTION

1. Field of the Invention

The present invention relates to an adjusting device for adjustably varying a tilt angle of a tilting axis of an axial piston pump/motor of a tilting axis type.

2. Description of the Prior Art

An adjusting device for an axial piston pump/motor of a tilting axis type in which a tilt angle of a valve plate is varied by rocking the valve plate along arcuate guide grooves provided in an end cover, has been heretofore known.

One example of such adjusting devices for an axial piston pump/motor of a tilting axis type in the prior art, is illustrated in FIG. 1. In this figure, reference numeral 1 designates a casing, numeral 2 designates a drive shaft supported by the casing 1, numeral 3 designates a cylinder block, numeral 4 designates a valve plate held in slide contact with a bottom surface of the cylinder block 3, numeral 5 designates a center pin fitted in an axial center bore of the cylinder block 3 and having its tip end pivotably supported by an axial center portion of the drive shaft 2, numeral 6 designates a plurality of cylinder bores disposed in the cylinder block 3 as arrayed in a circumferential direction, numeral 7 designates pistons fitted in the respective cylinder bores 6, and these pistons 7 are pivotably mounted to a tip end of the drive shaft 2 via a retainer 8. Reference numeral 9 designates a spring for biasing the cylinder block 3 towards the valve plate 4.

Reference numeral 11 designates an adjusting device, as a whole, for varying displacement of a pump/motor by rocking the above-mentioned valve plate 4 in one direction, and numeral 12 designates an end cover provided with guide grooves 13 for supporting and guiding the valve plate 4 so as to allow rocking thereof about the pivotal fulcrum of the center pin 5. In this end cover 12 is provided a cylinder 14 directed in the direction of rocking of the valve plate 4, and a single piston 15 is fitted in this cylinder 14. Reference numerals **16*a* and 16*b*, respectively, designate lids for closing the opposite ends of the cylinder 14. In the central portion along the longitudinal direction of the cylinder 14 is provided an aperture 14*a* opening in the bottom surface of the above-described guide grooves 13 as extending over the rocking range of the valve plate 4. A trunnion pin 17 is studded in the portion of this piston 15 opposed to the aperture 14*a*, and a tip end portion of this trunnion pin 17 is rockably engaged with an axial center portion of the valve plate 4**.

In the sector-shaped variable displacement piston pump/motor as described above, the valve plate 4 is made to rock along the guide prooves 13 provided in the end cover 12 via the trunnion pin 17 by reciprocating the piston 15, thereby a tilt angle of the cylinder block 3 with respect to the drive shaft 2 is varied, and hence, the displacement of the piston pump/motor can be varied.

In the above-described adjusting device 11 for an axial piston pump/motor of a tilting axis type in the prior art, since the stroke of the piston 15 and the rocking range (distance) of the valve plate 4 have the relation of 1:1, while the rocking radius of the valve plate 4 can be chosen to be large and hence the manipulation force can be made small, on the other hand the stroke of the piston 15 becomes long, and hence there was a problem that the adjusting device would become large-sized in the direction of stroke of the piston 15.

SUMMARY OF THE INVENTION

It is therefore on object of the present invention to provide an improved adjusting device for an axial piston pump/motor of a tilting axis type, which has a reduced size in the direction of adjustable rocking motion of a valve plate as compared to the known device in the prior art.

According to one feature of the present invention, there is provided an adjusting device for adjustably varying a tilt angle of a tilting axis of an axial piston pump/motor of a tilting axis type in which a sleeve or sleeves and a piston fitting in the sleeve or sleeves are contained in a telescopic structure within a cylinder formed in an end cover along a rocking direction of a valve plate, and a trunnion pin engaged with the valve plate is provided on the piston.

According to the present invention, owing to the above-featured construction of the adjusting device, the piston can be moved over a range consisting of a stroke of the piston relative to the sleeve plus a stroke of the sleeve relative to the cylinder, and hence there is an advantage that the valve plate can be rocked over a wide range consisting of a stroke of the piston plus a stroke of the sleeve without increasing an overall size of the adjusting device.

The above-mentioned and other objects, features and advantages of the present invention will become more apparent by reference to the following description of preferred embodiments of the invention taken in conjunction with the accompanying drawings.

BRIEF DESCRIPTION OF THE DRAWINGS

In the accompanying drawings

DETAILED DESCRIPTION OF THE PREFERRED EMBODIMENTS

Figure 1:
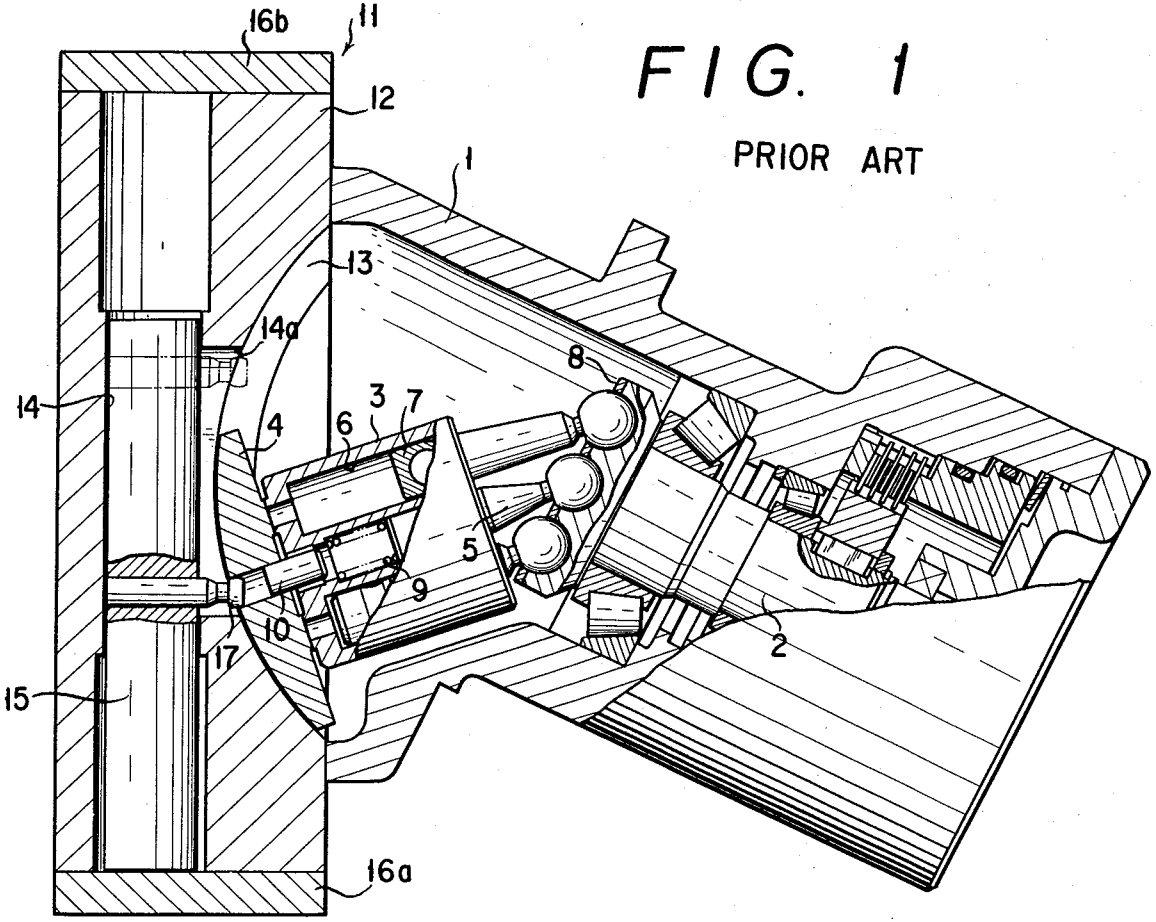
FIG. 1 PRIOR ART
FIG. 1 is a cross-sectional view showing an axial piston pump/motor of a tilting axis type in the prior art.
Figure 2:
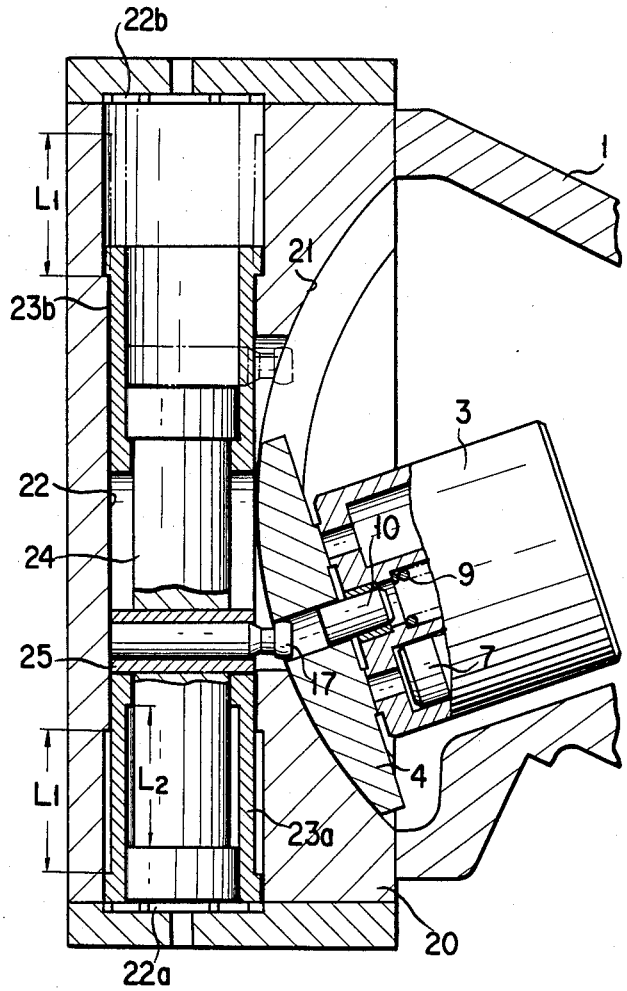
FIG. 2 is a cross-sectional view showing an essential part of one preferred embodiment of the present invention.

Referring now to FIG. 2 of the accompanying drawings, one preferred embodiment of the present invention is illustrated therein in cross-section. It is to be noted that in this figure, component parts equivalent to those used in the adjusting device in the prior art shown in FIG. 1 are given like reference numerals, and further explanation thereof will be omitted.

In FIG. 2, reference numeral 20 designates an end cover fixedly secured to a casing 1, numeral 21 designates guide grooves provided in an arcuate shape in the end cover 20, and a valve plate 4 is engaged with these guide grooves 21. Reference numeral 22 designates a cylinder formed in the end cover 20 as directed in the direction of sliding of the valve plate 4, sleeves **23*a* and 23*b* are fitted respectively in the opposite end portions of this cylinder 22 so as to be freely slidable over a stroke $L_1$, from the respective ends, in addition a piston 24 extending through the respective sleeves 23*a* and 23*b* is fitted in the respective sleeves 23*a* and 23*b* so as to be freely slidable over a stroke $L_2$ relative to the respective sleeves 23***a* and 23*b*, and these sleeves and piston form a telescopic structure. The opposite ends of these sleeves 23*a* and 23*b* and piston 24 are opposed to pilot pressure chambers 22*a* and 22*b*, respectively. And, a trunnion pin 17 rockably engaged with a axial center portion of the valve plate 4 is studded jointly with a holding cylinder 25 in the above-described piston 24. In the illustrated embodiment, the stroke $L_1$ of the respective sleeves 23*a* and 23*b* and the stroke $L_2$ of the piston 24 are chosen so as to fuffill the condition of $L_1=L_2$, and the composite stroke $L_1+L_2$ is made substantially identical to the rocking stroke of the valve plate 4.

In the prepared embodiment shown in FIG. 2, the state where the tilt angle of the valve plate 4 is maximum is illustrated, add under this state, the piston 24 is nested internally of the sleeve 23*a* and an internally acting tilting moment is the maximum. In order to reduce the tilt angle of the valve plate 4 starting from this state, a pilot pressure is applied to a pilot pressure chamber 22*a* which has a smaller volume due to movement of the sleeves 23*a* and 23*b* and the piston 24. Then the sleeves 23*a* and 23*b* and the piston 24 are moved integrally by the stroke $L_1$ of the sleeves 23*a* and 23*b*. When the sleeves 23*a* and 23*b* have struck against their stoppers and have stopped, only the piston 24 continues to move further, and then it stops under the condition where the piston 24 has moved by the stroke $L_2$ relative to the sleeves 23*a* and 23*b*.

Owing o the above-described operation, the valve plate 4 can be tilted by a large propelling force exerted via the sleeves and the piston at the large angle portion where the tilt angle of the valve plate 4 is the maximum, and from the middle of the stroke, it is tilted by a small propelling force exerted via the piston only.

It is to be noted that in the case where the valve plate 4 is driven from the state having the minimum tilt angle towards the state having the maximum tilt angle also, the valve plate 4 can be driven by a large propelling force via the sleeves and the piston until the valve plate 4 passes the middle of the stroke, and hence in the beginning of movement the valve plate 4 ca be moved smoothly by the large propelling force.

Figure 3:
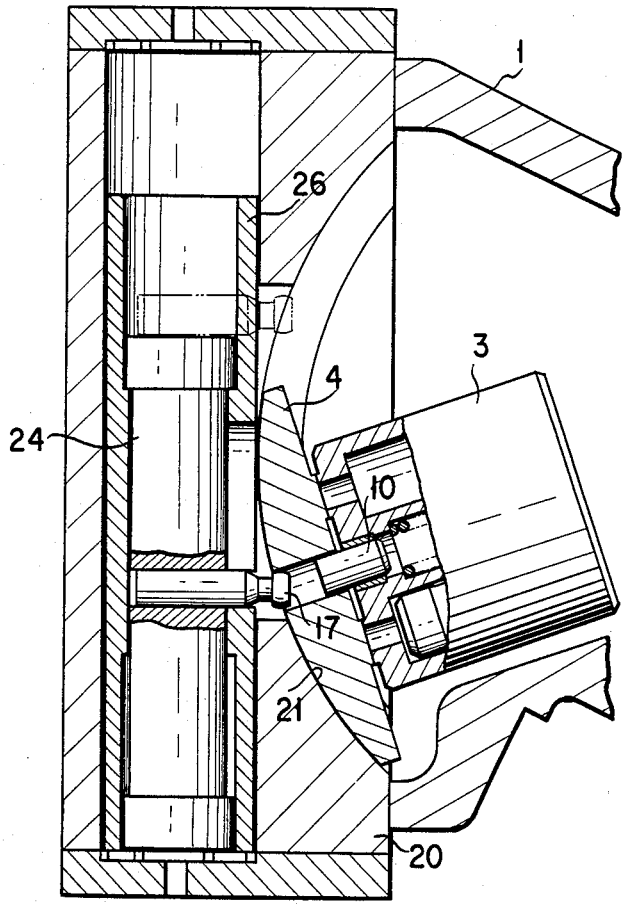
FIG. 3 is a cross-sectional view showing an essential part of another preferred embodiment of the present invention.

A modified embodiment of the present invention is illustrated in FIG. 3. The only difference between this modified embodiment and the first-described preferred embodiment shown in FIG. 2 resides in that in place of the two separate sleeves 23*a* and 23*b*, an integral single sleeve 26 is provided and it can achieve the same function as the sleeves 23*a* and 23*b* of the first preferred embodiment shown in FIG. 2. Therefore, further explanation of the modified embodiment in FIG. 3 will be unnecessary and will be omitted here.

According to the present invention, while the rocking radius of the valve plate 4 is kept identical to that of the heretofore known tilting axis type axial piston pump/motor, the stroke of the adjusting device for adjustably varying a tilt angle of a tilting axis type piston pump/motor can be reduced to ½ of the heretofore known adjusting device, and thereby a length of the adjusting device can be shortened. Therefore, in the case where the adjustable tilting axis type axial piston pump/motor according to the present invention is used as a travel driving motor of a power shovel, it is facilitated to install the axial piston motor inside of shoes of endless tracks, which was difficult for the axial piston motors in the prior art.

Since many changes and modifications can be made to the above-described construction without departing from the spirit of the present invention, it is intended that all matter contained in the above description and illustrated in the accompanying drawings shall be interpreted to be illustrative and not as a limitation to the scope of the invention.

What is claimed is:

1. An adjusting device for an axial piston/motor of a tilting axis type in which a tilt angle of a valve plate is varied by rocking said valve plate along arcuate guide grooves formed in an end cover of said axial piston pump/motor, comprising:

sleeve means and a piston slidably received in said sleeve means in a telescopic assembly within a cylinder formed in said end cover and extending in the rocking direction of said valve plate, said sleeve means being slidably movable internally of said cylinder with a portion of the length of said piston nested internally of said sleeve means when said sleeve means is moved to each end of said cylinder, and a trunnion pin mounted to said piston and engaged with said valve plate.

2. An adjusting device as claimed in claim 1 wherein said sleeve means comprises a pair of separate sleeves positioned at both end portions of said piston, respectively.

3. An adjusting device as claimed in claim 1 wherein said sleeve means comprises an integral single sleeve positioned substantially over said piston.

* * * * *